US005542320A

United States Patent [19]

Vasichek et al.

[11] Patent Number: 5,542,320

[45] Date of Patent: Aug. 6, 1996

[54] MAGNETIC KEEPER ACCESSORY FOR WRENCH SOCKETS

[75] Inventors: Richard A. Vasichek, Brocket; Robert J. Vasichek, Michigan; Dean S. Somerville, Rural Binford; Mitchel D. Trostad, Aneta, all of N. Dak.

[73] Assignee: Vasichek Enterprises LLC, Brocket, N. Dak.

[21] Appl. No.: 496,025

[22] Filed: Jun. 28, 1995

Related U.S. Application Data

[63] Continuation-in-part of Ser. No. 34,012, Jan. 25, 1995, Pat. No. Des. 369,075.

[51] Int. Cl.[6] ..... B25B 13/06

[52] U.S. Cl. ..... 81/125; 76/114

[58] Field of Search ..... 81/125; 76/114

[56] References Cited

U.S. PATENT DOCUMENTS

| | | | |
|---|---|---|---|
| 2,491,089 | 12/1949 | Cowden . | |
| 2,551,553 | 5/1951 | Wahl . | |
| 2,624,223 | 1/1953 | Clark . | |
| 2,750,828 | 6/1956 | Wendling . | |
| 2,778,669 | 1/1957 | Goodwin | 81/125 U X |
| 2,793,552 | 5/1957 | Clark . | |
| 2,806,396 | 9/1957 | Miller | 81/125 |
| 3,240,087 | 3/1966 | Estes | 81/125 |
| 3,288,002 | 11/1966 | Mankovitz . | |
| 3,320,563 | 5/1967 | Clark . | |
| 3,360,108 | 12/1968 | Stillwagon, Jr. . | |
| 3,392,767 | 7/1968 | Stillwagon, Jr. . | |
| 3,707,894 | 1/1973 | Stillwagon, Jr. . | |
| 3,731,722 | 5/1973 | Carr . | |
| 3,808,918 | 5/1974 | Carr | 81/125 |
| 3,834,253 | 9/1974 | Carr | 81/125 |
| 3,835,737 | 9/1974 | Carr | 81/125 |
| 3,869,945 | 3/1975 | Zerver | 81/125 |
| 4,663,998 | 5/1987 | Parsons et al. . | |
| 5,146,814 | 9/1992 | Vasichek . | |
| 5,199,334 | 4/1993 | Vasichek et al. . | |
| 5,277,088 | 1/1994 | Vasichek et al. . | |

*Primary Examiner*—James G. Smith

*Attorney, Agent, or Firm*—L. MeRoy Lillehaugen; Alan D. Kamrath

[57] ABSTRACT

An accessory (10) for a wrench socket (12) is disclosed including a generally cylindrical magnet (32) secured to a generally cylindrical, nonmagnetic, compressible disk (26). Specifically, the magnet (32) is received in a recess (46) formed in the disk (26) and secured to the disk (26) by a layer (60) of a size larger than and extending over the face (36) of the magnet (32) and integrally secured around its entire periphery to the face (44) of the disk (26). The disk (26) snuggly fits within the well (14) and magnetically insulates the magnet (32) from the socket (12). The magnet (32) has a size smaller than the well (14) and is generally concentric within the well (14), with an air space being created between the magnet (32) and the well (14) for magnetically insulating the magnet (32) from the socket (12) in the most preferred form. The accessory (10) is removably insertable into the socket (12) of any design and model and without need for modification of the socket (12) and captures a fastener (16) slideably received in the well (14) of the socket (12) to magnetically hold the fastener (16) captive in the well (14) as the socket (12) is moved to the fastening location while not magnetizing the socket (12) or the fastener (16) sufficiently to be detrimentally magnetically attracted to metal adjacent to the fastening location. In the most preferred form, the disk (26) further includes a second portion (54) of a size smaller than the first portion (52) for receipt in a connection passage (58) located intermediate the well (14) and the handle mounting end of the socket (12) and which is especially advantageous for sockets (12) having shallow depth wells (14).

20 Claims, 1 Drawing Sheet

MAGNETIC KEEPER ACCESSORY FOR WRENCH SOCKETS

CROSS REFERENCE

The present application is a continuation-in-part of application Ser. No. 29/034,012 filed Jan. 25, 1995 now design patent D369075.

BACKGROUND

The present invention relates generally to accessories for tools for initially holding fasteners thereto, and particularly to accessories for wrench sockets for initially holding fasteners captive therein.

While installing fasteners, it is often desirable to maintain the fastener with the tool until fastening is initially underway. Often it was necessary to hold the fastener relative to the tool with one hand while the tool was manipulated with the other hand. Because of limitations in space, access to the fastener by the hand holding the fastener and also by the tool itself was difficult if not impossible. Furthermore, due to the proximity of the hand to the fastener and the tool, the hand initially holding the fastener to the tool was especially prone to accidental injury. Thus, there is a well known need in the art for methods for temporarily holding the fastener to the tool until the fastening is initially underway.

Prior to the present invention, several methods have been devised for the use of magnetic forces to retain fasteners to the tool during fastening or removal of the fasteners. However, acceptance of such prior approaches in the art has been limited due to the inherent deficiencies in such prior approaches. For example, many of such approaches required specially manufactured and designed tools to incorporate the fastener retention feature and thus could not be utilized when the fastener retention feature was not desired and could not be utilized with standard tools already in use. Further, many of such approaches magnetized the entire tool so that the tool was not only magnetically attracted to the fastener but also to any metal in the path of the tool to the fastening location as well as metal surrounding the fastening location. Furthermore, many of such approaches were of complicated, multipiece designs incapable of being economically manufactured and assembled. Although U.S. Pat. Nos. 5,146,814; 5,199,334; and 5,277,088 represent a major advance in overcoming the inherent deficiencies in prior approaches, a continuing need exists for accessories which can be selectively utilized with conventional wrench sockets without modification thereto and which capture fasteners in the well of the socket.

It is thus an object of the present invention to provide a novel accessory for use in a wrench socket without need for modifying the wrench socket and for preventing fasteners from sliding from the well of the socket to hold the fastener captive in the well while the socket is being moved to the fastening location and while the fastener is being initially fastened. In this regard, such a tool will be especially helpful in assembling or disassembling goods in hard-to-get-at fastening locations and at greater efficiencies. Further, as many accidents happen when working in such hard-to-get-at fastening locations, the accessory will reduce the exposure of injury to the user's hand which was otherwise required to hold the fastener in the wrench socket. Furthermore, the accessory will reduce the chance of injury due to sharp threads cutting fingers holding the fastener while trying to initially thread such fasteners. Likewise, the accessory will allow persons having handicaps or other disabilities to utilize wrench sockets in fastening situations which they otherwise were unable to perform.

It is further an object of the present invention to provide such a novel accessory which captures the fastener in the well of the socket but also does not magnetize the socket or the fastener captured therein to such a degree to cause detrimental attraction of the socket and the fastener to metal surrounding the fastening location. For example, the socket and fastener will not be attracted to the metal block of an engine as it is moved adjacent thereto to the fastening location. In this regard, the accessory will increase efficiency and productivity. Specifically, the fastener is captured in the socket in a desired position and will not change orientation and/or fall therefrom due to gravitational forces. Thus, fasteners are easier to start with one hand operation, which is particularly desirable for use with pneumatic or electric speed wrenches.

SUMMARY

Suprisingly, the above objectives can be satisfied in the field of wrench sockets by providing, in the preferred form, an insert accessory for use in a conventional wrench socket without modification. The accessory includes a magnet secured to a nonmagnetic disk by a layer secured by its entire periphery to the face of the disk and being of a size larger than and extending over the face of the magnet. The disk snuggly fits within the well of the socket and magnetically insulates the magnet from the socket. The magnet is smaller than the well of the socket and is held by the disk generally concentric within the well of the socket creating a magnetically insulating air space between the magnet and the socket.

In other aspects of the present invention, the magnet is held in a recess of the nonmagnetic disk without requiring the use of glue or adhesive by having the layer integrally formed with the disk such as by forming the disk including the layer around the magnet.

In further aspects of the present invention, the nonmagnetic disk has first and second portions integrally attached together, with the periphery of the second portion being smaller than the periphery of the first portion and for receipt in the connection passage of the socket located intermediate the well and the handle mounting end.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
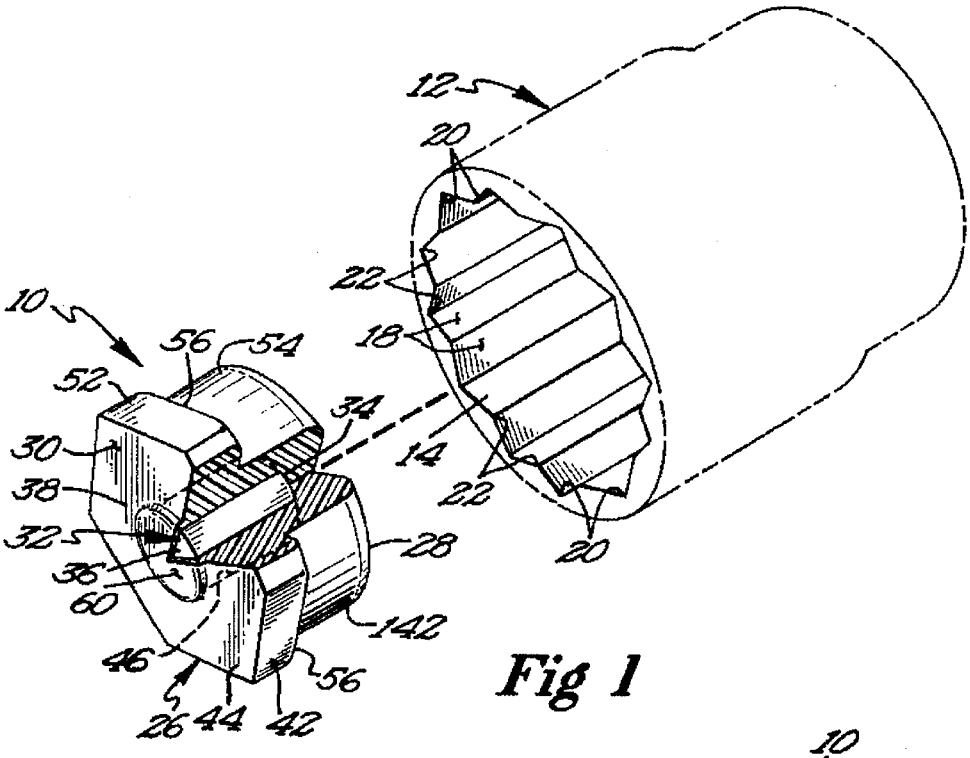
FIG. 1 shows an exploded perspective view of a fastener-keeping accessory for wrench sockets according to the preferred teachings of the present invention with the fastener-keeping accessory being broken away to show constructional details.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inside", "outside", "inner", "outer", and similar terms are used herein, it should be understood that these terms have reference only to the structure shown in the drawings as it would appear to a person viewing the drawings and are utilized only to facilitate describing the invention.

DESCRIPTION

An accessory for temporarily holding or keeping fasteners such as burrs or bolts captive with respect to a tool according to the preferred teachings of the present invention is shown in the drawings and generally designated 10. In the most preferred form, accessory 10 is utilized in conjunction with a tool in the form of a wrench socket 12. Socket 12 can be any standard design generally including a well 14 having a multisided periphery sized to axially slideably receive the corresponding sized head of a bolt, a burr, or like fastener 16 without allowing rotation of burr 16 relative thereto. Specifically, the outer ends of sides 18 forming well 14 intersect at corners 20 arranged at a diameter generally equal to the corners of burr 16 and the inner ends of sides 18 forming well 14 intersect at corners 22 arranged at a diameter less than the diameter of corners 20 or the corners of burr 16. Opposite well 14, socket 12 includes a handle mounting end including a noncircular opening 24 for slideably receiving a complementary shaped shank of any conventional wrench handle.

It should further be appreciated that some sockets 12 are manufactured with wells 14 of a shallow design and specifically do not extend the length of socket 12 to opening 24 but rather a connection tunnel or passage 58 is provided intermediate well 14 and opening 24. Passage 58 can have a variety of shapes but has a diameter less than well 14 and typically larger than opening 24. Sockets 12 of the type having such a connection passage 58 are commonly used in small size sockets 12 (i.e. having wells 14 for receipt of fasteners 16 having a cross sectional size of ½ inch (1.26 cm) or smaller) as well as by some manufacturers for larger size sockets 12.

In the preferred forms shown, accessory 10 includes a disk 26 of uniform thickness having planar, parallel, opposed faces 28 and 30, with faces 28 and 30 each lying in a single plane in the most preferred form. In the most preferred form, disk 26 is generally cylindrical in shape and includes a first generally cylindrical portion 52 integrally attached to a second generally cylindrical portion 54. Portion 52 includes face 30 and has periphery 42 having a size at least equal to well 14 such as greater than the diameter of corners 22 and in the most preferred form, generally equal to or slightly smaller than the diameter of corners 20. In the preferred form, periphery 42 is of a generally cylindrical shape and in the most preferred form having hexagonal cross sections similar to but slightly larger than the typical hexagonal cross sections of burr 16 intended to be received in socket 12. Portion 54 includes face 28 and has a periphery 142 having a diameter less than portion 52. Portion 54 is of a generally cylindrical shape and in the most preferred form having circular cross sections arranged concentrically with portion 52. A shoulder 56 is formed by portion 52 extending radially beyond portion 54 at their interconnection.

Disk 26 is formed of rubber or other suitable resilient, compressible, and nonmagnetic material of a flexible nature to allow portion 52 of disk 26 to be forced into well 14 with the outer periphery 42 deforming to pass around corners 22 and snuggly fit within well 14. In its most preferred form, disk 26 is formed of a polyurethane elastomer. Further, the fit of portion 52 of disk 26 should be such that disk 26 can be forced from well 14 by passing an elongated member through opening 24 and pushing against face 28 but preventing disk 26 from being shaken out of well 14 even after repeated insertions and removals from well 14.

Accessory 10 further includes a magnet 32 which in the preferred form is a ceramic magnet. However, for accessory 10 to be utilized in sockets 12 having wells 14 for receipt of relatively small fasteners 16 (i.e. having cross sectional sizes of 5/16 inch (0.8 c.m.) or smaller), magnet 32 may be formed of rare earth elements due to the limited size requirements and/or due to magnetic strength requirements. In the preferred form, magnet 32 is of uniform thickness having planar, parallel, opposed faces 34 and 36, with faces 34 and 36 each lying in a single plane in the most preferred form. Further, magnet 32 is generally cylindrical in shape and has a diameter less than disk 26 and less than the diameter of corners 22 of well 14.

In the most preferred form, magnet 32 is permanently secured to disk 26 according to the teachings of the present invention with face 36 of magnet 32 being spaced from face 30 of disk 26 and the periphery 40 of magnet 32 being spaced from peripheries 42 and 142 of disk 26 with annular portion 44 of face 30 of disk 26 extending beyond periphery 40 of magnet 32 according to the preferred teachings of the present invention. In the preferred forms shown, disk 26 includes recess 46 extending at a depth from face 30 towards but spaced from face 28 and spaced from peripheries 42 and 142. Recess 46 has a size and shape for receipt of periphery 40 of magnet 32. In the preferred form shown in FIGS. 1–3, the depth of recess 46 is less than the height of magnet 32 between faces 34 and 36 and the height of disk 26 between faces 28 and 30 but greater than the height of portion 52 from face 30 to shoulder 56. In the preferred form shown in FIG. 4, the depth of recess 46 is equal to the height of magnet 32 between faces 34 and 36, less than the height of disk 26 between faces 28 and 30 but greater than the height of portion 52 from face 30 to shoulder 56.

According to the teachings of the present invention, periphery 40 of magnet 32 and recess 46 are in the shape of a cylinder and magnet 32 is permanently secured to disk 26 within recess 46 by a thin layer 60 of nonmagnetic material of a size larger than and extending over face 36 of magnet 32 and secured around its entire periphery to face 30 of disk 26, with layer 60 being integrally secured to and from the same material as disk 26 without any joints. In the most preferred form, disk 26 including layer 60 is formed around magnet 32, with magnet 32 forming and defining recess 46 in the manufacturing process according to the teachings of the present invention. According to the teachings of the present invention, layer 60 must have a thinness allowing the magnetic field created by magnet 32 to pass through layer 60 and attract and hold burr 16 and in the most preferred form just covers face 36 of magnet 32 but having a thickness to prevent magnet 32 from pulling through or otherwise tearing layer 60. It has been found that the thickness of layer 60 necessary to prevent removal of magnet 32 is considerably less than what was originally anticipated, especially when disk 26 and layer 60 is formed around magnet 32 in the most preferred form. Specifically, although the material forming disk 26 may not have a tendency to bond to periphery 40 of magnet 32, if formed around magnet 32, layer 60 and disk 26 does tend to bond to faces 34 and 36 of magnet 32. Layer 60 bonded to face 36 has less of a tendency to tear such that the thickness of layer 60 can be minimized. In the preferred form, layer 60 has a maximum thickness which does not generally detrimentally reduce the strength of the magnetic field and in the most preferred form does not exceed about 0.005 inch (0.127 mm), has a minimum thickness which is not subject to tearing and in the most preferred form is not less than about 0.001 inch (0.0254 mm), and in the most preferred form is in the range of 0.002 to 0.003 inch (0.0508 to 0.0762 mm).

Now that the basic construction of accessory 10 according to the preferred teachings of the present invention has been explained, the operation and subtle features of accessory 10 can be set forth and appreciated. Specifically, when it is desired to initially hold burr 16 captive within well 14 of socket 12, accessory 10 can be positioned adjacent the open end of well 14 with periphery 42 of disk 26 extending over the inner periphery of well 14 and abutting with socket 12. At that time, accessory 10 can be pushed forcing disk 26 to pass into well 14 to compress disk 26 into well 14 with a snug, friction fit. Accessory 10 can be pushed into well 14 until face 28 is adjacent to or abuts with the handle mounting end and closes off the inner end of opening 24 of socket 12.

Figure 2:
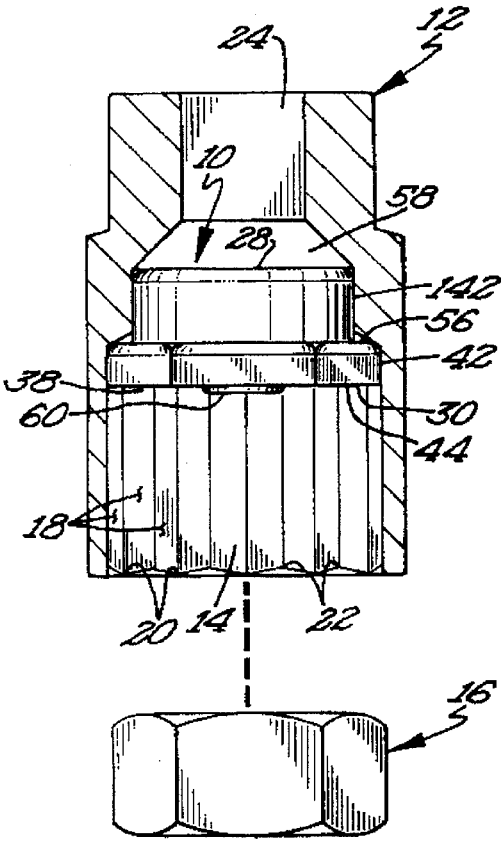
FIG. 2 show a cross-sectional view of the wrench socket including the fastener-keeping accessory of FIG. 1 and burr exploded therefrom.
Figure 3:
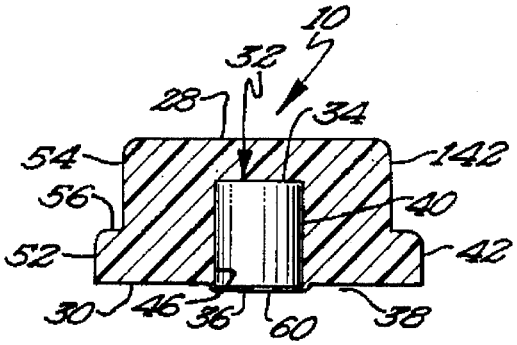
FIG. 3 shows a cross-sectional view of the fastener-keeping accessory of FIG. 1.
Figure 4:
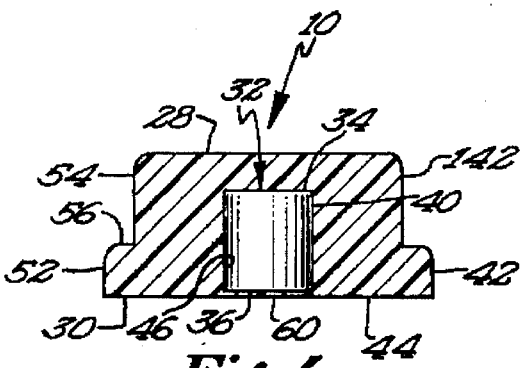
FIG. 4 shows a cross-sectional view of an alternate embodiment of a fastener-keeping accessory for wrench sockets according to the preferred teachings of the present invention.

Due to the concentric mounting of magnet 32 relative to disk 26 and the smaller diameter of magnet 32 than well 14, an annular air space 38 will be created between periphery 40 of magnet 32 and well 14 of accessory 10 of the preferred form shown in FIGS. 1–3. It can then be appreciated that socket 12 is magnetically insulated from magnet 32 by disk 26 and air space 38. Specifically, due to the nonmagnetic material forming disk 26, disk 26 effectively prevents passage of the magnetic field of magnet 32 to the handle mounting end of socket 12. Likewise, due to the general inability of magnetic fields from passing through air, air space 38 effectively prevents magnetizing socket 12 between magnet 32 and well 14. Thus, although burr 16 positioned within well 14 and abutting with face 36 of magnet 32 will be attracted to and held by magnet 32 within well 14 of socket 12, the magnetic field created within socket 12 itself and the captured burr 16 will not be sufficient to be detrimentally attracted to any metal in the path of socket 12 to the fastening location as well as metal surrounding the fastening location.

Due to the magnetic insulation on all sides of magnet 32 by disk 26 and air space 38 except for face 36, the magnetic attraction between burr 16 and face 36 is enhanced. Thus, the strength required for magnet 32 to effectively capture burr 16 within well 14 is minimized, with the attraction of socket 12 to metal also dependent on the strength of magnet 32 also being minimized.

It should be appreciated that sockets 12 are made by various manufacturers and are of various designs and configurations including with varying number of sides 18 forming well 14. However, as sockets 12 of whatever design must correspond to and slideably receive burrs 16 to be operable, the diameter of corners 20 must be generally standard and corresponding to that of burrs 16. Accessory 10 according to the teachings of the present invention takes advantage of this feature to allow use in conventional sockets 12 of whatever design and without modification. Specifically, disk 26 can be sized according to the diameter of corners 20 of the particular sized socket 12 for which accessory 10 is desired to be utilized. Disk 26 can then be pushed into well 14 of socket 12 deforming to match the periphery of well 14 regardless of the number of sides 18 or the diameter of corners 22 of the particular socket 12 which accessory 10 is to be utilized. In fact, as accessory 10 is bound in well 14 by disk 26 deforming around corners 22 and along sides 18, high tolerances are possible between the relationship between the diameters of disk 26 and corners 20 such that accessory 10 can be utilized through a range of socket sizes such as for generally corresponding standard American (inch) or metric sizes.

It should be understood that magnets 32 have to have a minimum mass to have sufficient strength to magnetically hold fastener 16 in well 14. Additionally, the diameter of recess 46 must be smaller than the periphery of disc 26 to insure sufficient material exists between periphery 40 of magnet 32 and well 14 to magnetically isolate magnet 32 from socket 12 and reduce shock and stress transference to magnet 12. Accessory 10 utilizing disk 26 of the most preferred form shown is then particularly advantageous for use in sockets 12 having shallow wells 14. Particularly, periphery 142 has a size and shape corresponding to and for receipt in connection passage 58 and preferably for slideable receipt in connection passage 58 with a snug fit to assist portion 52 in holding accessory 10 within socket 12 while still allowing accessory 10 to be forced from socket 12 by passing an elongated member through opening 24 and pushing against face 28. However, periphery 142 can be smaller than connection passage 58. Disk 26 can then be pushed into well 14 with face 28 extending into connection passage 58 until shoulder 56 abuts with the end of well 14 and its interconnection to connection passage 58. It can then be appreciated that face 34 of magnet 32 is located in connection passage 58 below well 14. Thus, face 36 of magnet 32 is located deeper in well 14 leaving more room for receipt of fastener 16 in sockets 12 having shallow depths. Additionally, magnet 32 and recess 46 in disk 26 can be made with smaller diameters and longer in length to insure that the radial thickness of disk 26 is sufficient to magnetically isolate magnet 32 from socket 12 and to increase the surface area of recess 46 which engages magnet 32 to reduce shock and stress transference to magnet 32. It can be appreciated that in the event that accessory 10 having disk 26 is utilized in sockets 12 having deep wells 14 of the type shown and specifically typically not including connection passage 58, disk 26 is pushed in well 14 until face 28 abuts with opening 24.

Further, in addition to being usable with any make or model of socket 12 without need for modifying socket 12, accessory 10 can be removed easily from socket 12 by pushing an elongated member through opening 24 thereby forcing accessory 10 from socket 12 and allowing standard use of socket 12. Due to the resilient compressible nature of disk 26 of the most preferred form, accessory 10 can be inserted into and removed from well 14 a multiplicity of times without detrimentally affecting the utilization of accessory 10.

Prior to the present invention, magnets were typically glued or otherwise adhered to their carriers. Over time, such methods of securement were prone to release due to the aging of such glue or adhesive, the vibration from the application of torque, or the exposure to chemicals such as gasoline, solvents, fuels, or the like in the work area and which have a tendency to break down glues, adhesives or the like. Other approaches of permanently securing the magnets to the carriers, such as shown in U.S. Pat. Nos. 2,806,396 and 5,199,334, involved the use of specially shaped magnets. However, such specially shaped magnets required expensive capital costs resulting in accessories which do not have wide market acceptance believed due to perceived expensive purchase costs. Accessory 10 according to the teachings of the present invention utilizes layer 60 to permanently secure magnet 32 to disk 26 without requiring the use of glue, adhesive, or the like between magnet 32 and disk 26 or layer 60 and in the most preferred form also between disk 26 and layer 60. Thus, accessory 10 overcomes the deficiencies which resulted from the use of glue, adhesive, or the like. Furthermore, in the most preferred form, the number of steps required in manufacture is also reduced at least due to the elimination of the application step of glues, adhesive, or the like. Further, magnets 32 of accessory 10 of the preferred form of the present invention is of a standard variety not requiring expensive capital costs for their fabrication.

It should be noted that shock or pounding forces can result in chipping, demagnetization, or other damage to magnet 32. In addition to removably positioning magnet 32 into and magnetically insulating magnet 32 from socket 12, disk 26 takes up and absorbs vibration resulting from use of pneumatic tools in applying torque to socket 12 to fasten or loosen burr 16. It should then be further noted that a major transfer of vibration and shock loads to magnet 32 occurs from burr 16 due to its close proximity thereto. It can then be appreciated that accessory 10 according to the teachings of the present invention includes layer 60 positioned between burr 16 and magnet 32 to prevent direct abutment and which takes up and absorbs vibration and shock loads between burr 16 and magnet 32 to reduce damage to magnet 32 and thus extend its useful life.

In addition to securing magnet 32 in disk 26 and its shock absorption functions, layer 60 according to the present invention protects magnet 32 from elements in the environment which could be absorbed through face 36 of magnet 32 and result in reduction in its magnetic field strength, with the material forming layer 60 having less of a tendency to absorb such elements in comparison to face 36 of magnet 32 which is comparatively porous. Furthermore, in the event that contamination of accessory 10 should occur, with such contamination potentially reducing the effectiveness of magnet 32 such as from the physical separation resulting from its mere existence or from its particular magnetic characteristics, such contamination can be easily wiped off from disc 26 and layer 60, which does not tend to absorb such contaminants, than if face 36 were partially or completely exposed.

In the most preferred form, accessory 10 has a thickness such that burr 16 or the head of a bolt or similar fastener of a standard size extends beyond well 14 and out of socket 12 such as in the range of one-sixteenth inch (1.6 mm) to allow ease of removal of burr 16 from well 14 while still insuring that burr 16 extends sufficiently in well 14 to prevent relative rotation therebetween. Additionally, due to the snug fit, accessory 10 is slideably adjustable inside of well 14 to positions spaced from the handle mounting end of socket 12 so that burr 16 or similar fastener of a thinner size extends beyond well 14 and out of socket 12 to allow ease of removal of burr 16 from well 14. Specifically, accessory 10 can be adjustably positioned in well 14 by passing an elongated member through opening 24 and pushing against face 28 to slide accessory 10 to the desired position inside of well 14.

Although the operation of accessory 10 of the above invention was described with reference to a nut or burr 16, it can be appreciated that accessory 10 can be utilized to capture the head of a bolt or other fasteners within well 14 of socket 12. Likewise, although the operation of accessory 10 of the above invention was described with reference to fastening fastener 16, it can be appreciated that accessory 10 can be utilized to capture fastener 16 when removing fastener 16 from the fastening location.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

We claim:

1. Accessory for use in a wrench socket without need for modifying the wrench socket, with the wrench socket being of a conventional design including a well having an inner periphery formed by multiple sides intersecting at outer corners and including a handle mounting end, with the well slideably receiving a fastener, with the accessory preventing the fastener from sliding from the well to hold the fastener captive in the well while the socket is being moved to the fastening location, comprising, in combination: a nonmagnetic disk having planar, parallel, opposed, first and second faces, and a periphery having at least portions of a size at least equal to the inner periphery of the well; a generally cylindrical magnet having planar, parallel, opposed, first and second faces and a periphery smaller than the inner periphery of the well, with the magnet creating a magnetic field, with the second face of the magnet being spaced from the second face of the disk and the periphery of the magnet being spaced from the periphery of the disk with an annular portion of the second face of the disk extending beyond the periphery of the magnet; and a layer of a thinness allowing the magnetic field of the magnet to pass through the layer and attract and hold the fastener, with the layer secured to the annular portion of the second face of the disk, with the layer extending over the second face of the magnet for securing the magnet to the disk, with the disk snuggly fitting within the inner periphery of the well with the magnet positioned on the opposite side of the first face of the disk than the handle mounting end of the socket with the disk magnetically insulating the magnet from the socket and with the magnet positioned generally concentrically within the inner periphery of the well creating an air space between the inner periphery of the well and the periphery of the magnet for magnetically insulating the magnet from the socket.

2. The accessory of claim 1 wherein the disk is formed of a polyurethane elastomer, with the layer having a thickness generally in the range of 0.002 to 0.003 inch (0.0508 to 0.0762 mm).

3. The accessory of claim 1 wherein the layer is bonded to the second face of the magnet.

4. The accessory of claim 1 wherein the second face of the magnet lies in a single plane.

5. The accessory of claim 4 wherein the annular portion of the second face of the disk lies in a single plane.

6. The accessory of claim 1 wherein the layer includes a periphery, with the entire periphery being secured to the annular portion of the second face of the disk.

7. The accessory of claim 6 wherein the layer and the disk are formed of the same material, with the entire periphery being integrally secured to the annular portion of the second face of the disk without joints.

8. The accessory of claim 1 wherein the nonmagnetic disk further includes a recess extending at a depth from the second face of the disk towards but spaced from the first face of the disk and spaced from the periphery of the disk, with the recess having a size and shape for receipt of the magnet, with the layer securing the magnet to the disk inside of the recess.

9. Accessory for use in a wrench socket without need for modifying the wrench socket, with the wrench socket being of a conventional design including a well having an inner periphery formed by multiple sides intersecting at outer corners and including a handle mounting end, with the well slideably receiving a fastener, with the accessory preventing the fastener from sliding from the well to hold the fastener captive in the well while the socket is being moved to the fastening location, comprising, in combination: a nonmagnetic disk having planar, parallel, opposed, first and second faces, a periphery having at least portions of a size at least equal to the inner periphery of the well, and a recess extending at a depth from the second face of the disk towards but spaced from the first face of the disk and spaced from the periphery of the disk; a generally cylindrical magnet having planar, parallel, opposed, first and second faces and a periphery smaller than the inner periphery of the well, with the magnet creating a magnetic field, with the recess having a size and shape for receipt of the magnet with the periphery of the magnet being spaced from the periphery of the disk with an annular portion of the second face of the disk extending beyond the periphery of the magnet; and a layer of a thinness allowing the magnetic field of the magnet to pass through the layer and attract and hold the fastener, with the layer secured to the annular portion of the second face of the disk, with the layer extending over the second face of the magnet for securing the magnet to the disk inside of the recess, with the disk snuggly fitting within the inner periphery of the well with the magnet positioned on the opposite side of the first face of the disk than the handle mounting end of the socket with the disk magnetically insulating the magnet from the socket and with the magnet positioned generally concentrically within the inner periphery of the well.

10. The accessory of claim 9 wherein the disk is formed of a polyurethane elastomer, with the layer having a thickness generally in the range of 0.002 to 0.003 inch (0.0508 to 0.0762 mm).

11. The accessory of claim 9 wherein the layer is bonded to the second face of the magnet.

12. The accessory of claim 11 wherein the depth of the recess is less than the height between the first and second faces of the magnet.

13. The accessory of claim 9 wherein the second face of the magnet lies in a single plane.

14. The accessory of claim 13 wherein the annular portion of the second face of the disk lies in a single plane.

15. The accessory of claim 9 wherein the layer includes a periphery, with the entire periphery being secured to the annular portion of the second face of the disk.

16. The accessory of claim 9 wherein at least portions of the periphery of the disk have cross sections of a hexagonal shape.

17. The accessory of claim 9 wherein the nonmagnetic disk has first and second portions integrally attached together, with the first portion including a periphery of a size at least equal to the inner periphery of the well, with the second portion including a periphery smaller than the periphery of the first portion and than the inner periphery of the well, with the recess extending at a depth from the second face of the disk towards but spaced from the first face of the disk and spaced from the peripheries of the first and second portions of the disk, with the first portion of the disk snuggly fitting within the inner periphery of the well.

18. The accessory of claim 9 wherein the layer covers the entire second face of the magnet.

19. Method for forming an accessory for use in a wrench socket without need for modifying the wrench socket, with the wrench socket being of a conventional design including a well having an inner periphery formed by multiple sides intersecting at outer corners and including a handle mounting end, with the well slideably receiving a fastener, with the accessory preventing the fastener from sliding from the well to hold the fastener captive in the well while the socket is being moved to the fastening location, comprising the steps of: providing a generally cylindrical magnet having planar, parallel, opposed, first and second faces and a periphery smaller than the inner periphery of the well, with the magnet creating a magnetic field; and forming a nonmagnetic disk around the magnet, with the disk having planar, parallel, opposed, first and second faces, a periphery having at least portions of a size at least equal to the inner periphery of the well, and a recess extending at a depth from the second face of the disk towards but spaced from the first face of the disk and spaced from the periphery of the disk, with the periphery of the magnet being spaced from the periphery of the disk with an annular portion of the second face of the disk extending beyond the periphery of the magnet, with the disk further having a layer of a thinness allowing the magnetic field of the magnet to pass through the layer and attract and hold the fastener, with the layer secured to the annular portion of the second face of the disk, with the layer extending over the second face of the magnet for securing the magnet to the disk inside of the recess, with the disk snuggly fitting within the inner periphery of the well with the magnet positioned on the opposite side of the first face of the disk than the handle mounting end of the socket with the disk magnetically insulating the magnet from the socket and with the magnet positioned generally concentrically within the inner periphery of the well.

20. The method of claim 19 wherein the forming step comprises the step of bonding the layer to the second face of the magnet, with the layer having a thickness generally in the range of 0.002 to 0.003 inch (0.0508 to 0.0762 mm).

* * * * *